US008132562B1

(12) United States Patent
Perkinson, Jr.

(10) Patent No.: US 8,132,562 B1
(45) Date of Patent: Mar. 13, 2012

(54) ILP RAIL-GUN ARMATURE AND RAILS

(75) Inventor: Harry Ebiff Perkinson, Jr., Dallastown, PA (US)

(73) Assignee: Texas Research International, Inc., Austin, TX (US)

( * ) Notice: Subject to any disclaimer, the term of this patent is extended or adjusted under 35 U.S.C. 154(b) by 0 days.

(21) Appl. No.: 12/928,738

(22) Filed: Dec. 17, 2010

(51) Int. Cl.
*F41B 6/00* (2006.01)

(52) U.S. Cl. ..... 124/3

(58) Field of Classification Search ..... 124/3, 54; 89/8; 310/12.07

See application file for complete search history.

(56) References Cited

U.S. PATENT DOCUMENTS

| | | | | |
|---|---|---|---|---|
| 3,727,513 | A | | 4/1973 | Wicks |
| 4,641,567 | A | | 2/1987 | Creedon |
| 4,681,015 | A | | 7/1987 | Creedon |
| 4,681,016 | A | | 7/1987 | Creedon |
| 4,840,106 | A | | 6/1989 | Jasper, Jr. |
| 4,854,215 | A | | 8/1989 | Jasper, Jr. |
| 4,858,511 | A | | 8/1989 | Jasper, Jr. |
| 4,884,489 | A | | 12/1989 | Zowarka et al. |
| 4,945,810 | A | | 8/1990 | Parker |
| 4,953,441 | A | | 9/1990 | Weldon et al. |
| 5,076,135 | A | | 12/1991 | Hurn et al. |
| 5,078,042 | A | | 1/1992 | Jensen |
| 5,138,929 | A | | 8/1992 | Weldon et al. |
| 5,183,957 | A | | 2/1993 | Weldon et al. |
| 5,189,244 | A | | 2/1993 | Weldon |
| 5,237,904 | A | * | 8/1993 | Kuhlmann-Wilsdorf ..... 89/8 |
| 5,297,468 | A | | 3/1994 | Dreizin |
| 5,417,140 | A | | 5/1995 | Onozuka et al. |
| 5,454,289 | A | | 10/1995 | Bacon et al. |
| 5,844,161 | A | | 12/1998 | Meger |
| 5,856,630 | A | | 1/1999 | Meger |
| 6,200,102 | B1 | | 3/2001 | Diaz |
| 6,622,713 | B1 | | 9/2003 | Thomas |
| 6,725,759 | B1 | | 4/2004 | Kathe et al. |
| 7,077,046 | B2 | | 7/2006 | Nelyubin |
| 7,077,047 | B2 | | 7/2006 | Frasca |
| 7,152,357 | B2 | | 12/2006 | Huston |
| 7,409,900 | B1 | | 8/2008 | Nechitailo et al. |
| 7,503,249 | B2 | | 3/2009 | Jackson et al. |
| 2006/0011055 | A1 | | 1/2006 | Root, Jr. |
| 2010/0194212 | A1 | * | 8/2010 | Proulx ..... 310/12.07 |

* cited by examiner

*Primary Examiner* — Troy Chambers

(74) *Attorney, Agent, or Firm* — Michael A. Ervin; M.A. Ervin & Associates

(57) ABSTRACT

A rail gun armature assembly utilizing unique carbon-carbon composite materials and armature design to enable repeated use of very high velocity projectile firings with minimal damage to rail guns, and a rail gun rail assembly utilizing unique carbon-carbon composite materials to enable repeated use of very high velocity projectile firings with greatly reduced damage to the gun rails.

10 Claims, 3 Drawing Sheets

ILP RAIL-GUN ARMATURE AND RAILS

BACKGROUND OF THE INVENTION

1. Field of the Invention

The present application is directed to electromagnetic rail-guns and, more particularly, to projectiles launched from electromagnetic rail-guns and the conducting rails used in the rail-gun system.

2. Description of Related Art

Electromagnetic rail-guns utilize an electromagnetic force called the Lorentz force to propel an electrically conductive integrated launch package (ILP). In a typical electromagnetic rail-gun, the ILP slides between two parallel rails and acts as a sliding switch or electrical short between the rails. By passing a large electrical current down one rail, through the ILP, and back along the other rail, a large magnetic field is built up behind the ILP, accelerating it to a high velocity by the force of the current times the magnetic field. An electromagnetic rail-gun is capable of launching an ILP to velocities greater than fielded powder guns, thereby achieving greater ranges and shorter flight times to engagement.

A conventional prior art electromagnetic rail-gun utilizes two long parallel rails capable of carrying a large current. A sliding, conducting armature is positioned between the two rails. The armature is adapted to slide between the two rails along their entire length. Application of a voltage across two ends of the two rails causes a large current pulse to flow through one rail, through the armature, and into the other rail. The current generates a magnetic field. The Lorentz force created by the interaction of the magnetic field with the current in the armature causes the armature to be rapidly propelled between the two rails in a direction away from the points of application of the voltage. The armature itself may be projected like a bullet at a target, or the armature may be used to push a bullet-type projectile (ILP) at high velocity towards a chosen target.

A disadvantage of the conventional rail-gun is that arcing and heating may occur between the armature and rails. The heating is due to $I^2R$ losses and the arcing is due to poor contact between the armature and rails.

Maintaining good electrical contact between the armature and the rails over the entire length of the rails without causing too much friction is a serious problem that has impeded rail gun development to date. If the contact between the armature and rails is too tight, friction slows the armature, metal fusion occurs, and degrades projectile velocity. If the contact between the armature and rails is too loose, arcing occurs. Significant damage to the rails can occur due to the friction of the armature, metal fusion, and arcing. Damage to the rails results in limited life for the EMRG rails necessitating replacement of the rails.

The early electromagnetic rail guns incorporated a solid armature that was propelled between the rails by the electromagnetic force generated by the current flow through the armature and the rails. However, it was soon found that at high speeds around one kilometer per second, the rails and armature were substantially damaged, possibly as a result of ohmic heating and/or internal forces. Further, increases in current flow tended to increase rail and armature gouging.

Current rail gun armature materials are less than optimal because the conditions encountered during launch deteriorate the armatures, which leads to degradation of the rails. Aluminum alloys in the 6000 and 7000 series are the most commonly used materials for armatures. Thermal stresses, caused by loss of armature/rail contact, typically dominate armature deterioration. One theory of the physics of rail gun launch is that when the current pulse decreases from peak level, there is a local magnetic force field reversal in the armature leg, leading to the loss of contact pressure. Because of this local reversal, the magnetic force field is no longer able to counteract the blow-off force generated by the current through the armature-rail contact. At this point in time, the aluminum armature material has been heated to very high temperature, exceeding the melting point of the aluminum at the armature/rail contact. With the elevated temperature, the aluminum's mechanical properties are no longer sufficient to prevent the legs of the armature from moving away from the rail. This loss of contact resulting in increased arcing and further melting of the armature material. Evidence of the heat experienced by the armature can be seen in recovered armatures. Aluminum armatures frequently contain intragranular cracks after firing, suggesting high tensile stresses along the z-axis. Rapid, intense heating followed by surface cooling causes these discontinuities (1).

Rail damage comes in many forms. Some damage is caused at start up, such as rail damage in the form of axial grooves. The grooves are not associated with hypervelocity gouging or transition, but occur below 1 MA of current. At 1.4-1.7 MA, a single shot evidences this damage, but after 20 shots at 1.5 MA, the life of copper rails becomes limited. Localized electrical heating of the rail melts the armature aluminum, which erodes the rails at startup (2). The most troublesome damage is incurred during the transition from metal to metal contact to plasma contact during firing, which causes significant melting of the aluminum. The melted aluminum adversely reacts with the copper rails, forming aluminide and creating pitting and gouging in the rails.

Thus a new approach to armatures and rails is needed, one that enables repeated use of very high velocity projectile firings with minimal damage to the gun rails.

BRIEF SUMMARY OF THE DISCLOSURE

This need is met by an electromagnetic rail gun comprising: a pair of spaced rails defining an elongated bore therebetween and operable for receiving an armature along the length of said elongated bore, said armature having a leading edge and a trailing edge; a power supply connected to the spaced rails to provide a current flow path through one of the rails, through the armature, and into the other rail to propel the armature along the elongated bore in the direction of the leading edge of the armature; wherein said armature and possibly the spaced rails are fabricated from a fiber pre-form that is carbonized and then infused with a carbon matrix, and then carbonized again; and wherein this carbonized form is further infused with a carbon matrix and carbonized repeatedly until a pre-defined density is achieved; and wherein after said pre-defined density is achieved the carbonized form is heated in a non-oxidizing environment until the carbon transforms to a graphatized structure.

In one aspect of this method the carbon matrix used is pitch.

In another aspect the fiber pre-form is formed in a 3-dimensional cylindrical weave.

In another aspect the fiber pre-form is formed in a 3-dimensional orthogonal weave.

In another aspect the fiber pre-form is formed in a 4-dimensional cylindrical weave.

In another aspect the fiber pre-form, either 2, 3, or 4-dimensional, is reinforced with high conductivity refractory metal, such as tungsten.

In another aspect the fiber pre-form is formed such that refractory metal forms a preform backbone aligned to the predominate current pathway through the armature.

In another aspect a non-refractory metal is added to the pre-form after it has been carbonized, densified, and graphitized.

A rail gun armature assembly utilizing unique carbon-carbon composite materials and armature design to enable repeated use of very high velocity projectile firings with minimal damage to rail guns meets this need. In addition a rail gun rail utilizing unique carbon-carbon composite materials to enable repeated use of very high velocity projectile firings with greatly reduced damage to the gun rails meets this need.

BRIEF DESCRIPTION OF THE DRAWINGS

For a more complete understanding of the present invention, reference is now made to the following drawings, in which.

DETAILED DESCRIPTION OF THE DISCLOSURE

In the following detailed description, reference is made to the accompanying drawings that illustrate embodiments of the present invention. These embodiments are described in sufficient detail to enable a person of ordinary skill in the art to practice the invention without undue experimentation. It should be understood, however, that the embodiments and examples described herein are given by way of illustration only, and not by way of limitation. Various substitutions, modifications, additions, and rearrangements may be made without departing from the spirit of the present invention. Therefore, the description that follows is not to be taken in a limited sense, and the scope of the present invention is defined only by the appended claims.

Figure 1:
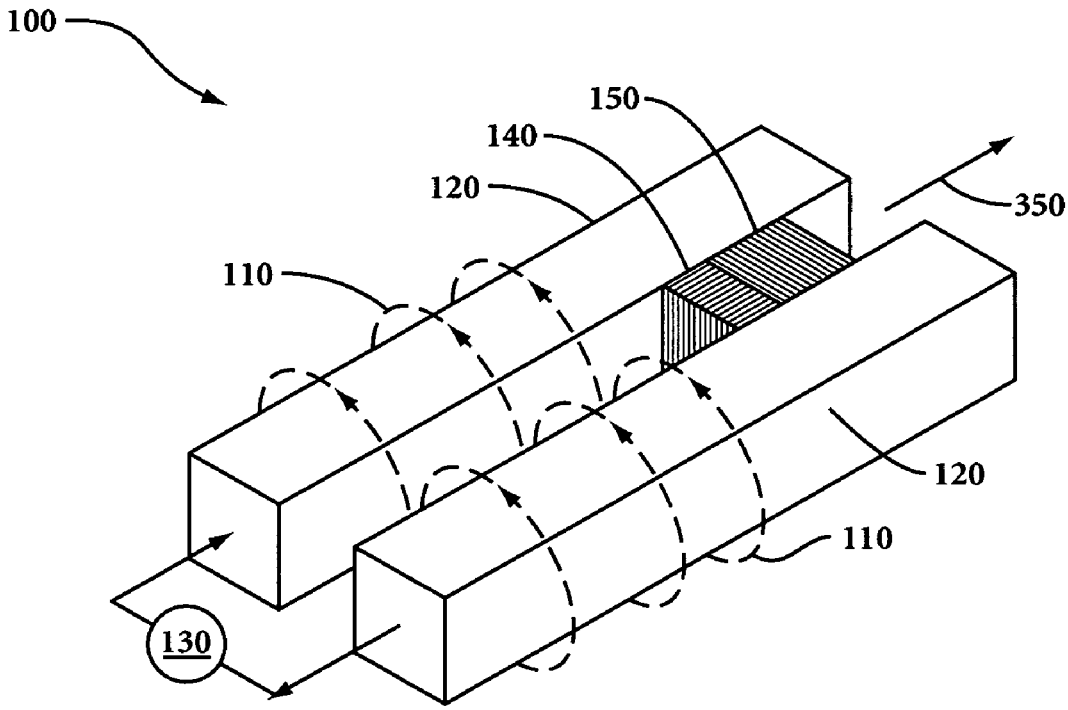
FIG. 1 represents a typical rail gun configuration.

An electromagnetic rail gun 100 is shown isometrically in FIG. 1. Two rails 120 are on either side of a central core in which an armature 140 rides behind, or in some cases slightly surrounds, a projectile 150. A large electric current 130 is introduced from an electrical source along the rails 120. This induces a magnetic field 110 around rails 120 that produces a mutual repulsive force to accelerate armature 140 in the longitudinal direction 350. The armature 140 pushes the projectile 150 to be propelled out of the rail gun.

Figure 2:
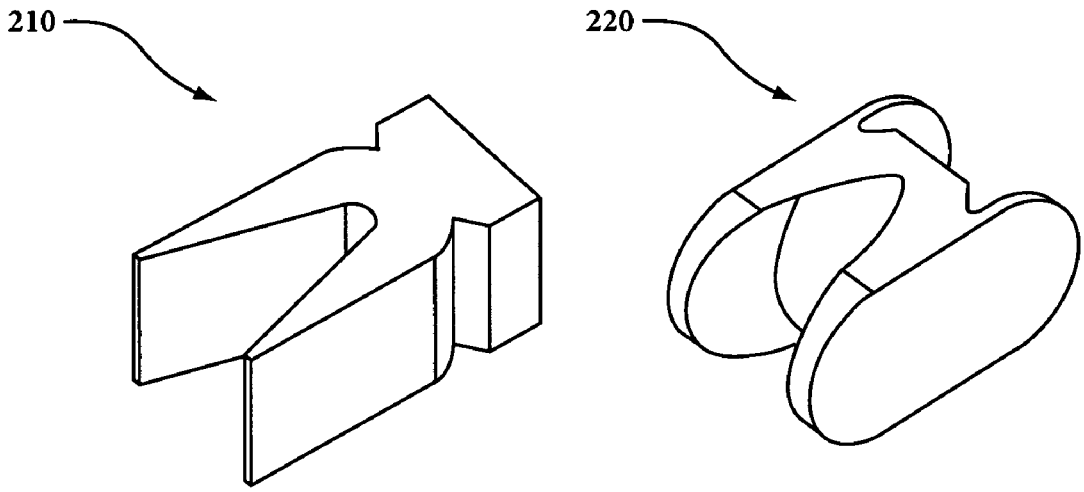
FIG. 2 is an illustration of two aspects of the design of the instant invention.

Numerous designs have been proposed for such armatures. FIG. 2 illustrates two potential designs 210 and 220.

While the 3-dimensional design of the armature is important it has been found that a key weakness of current systems is material related. Aluminum armatures simply do not stand up well at the extremely high current flows and resulting high temperatures of the rail gun environment. With the elevated temperature, the aluminum's mechanical properties are no longer sufficient to prevent the legs of the armature from moving away from the rail. This loss of contact resulting in increased arcing and further melting of the armature material. Evidence of the heat experienced by the armature can be seen in recovered armatures. Aluminum armatures frequently contain intragranular cracks after firing, suggesting high tensile stresses along the z-axis.

The rail erosion is the driving limitation to rail gun robustness in that current rail life is insufficient. The rail erosion is caused by rail/armature interaction at high temperature, resulting in pitting, grooving, and wearing of the rail. The erosion of the rail contributes to the increase in arcing which leads to further degradation of the conducting rails.

It has been found that these problems in both the armature and rails can be addressed by certain specially formulated carbon-carbon composites. Carbon-carbon composites are composite materials that are fabricated from a fiber preform that is carbonized and then infused with a carbon matrix, sometimes in the form of pitch, which is then carbonized again. In the proposed method a preformed carbonized form is infused with pitch and carbonized repeatedly until the desired material density is achieved. Upon reaching the required density, the carbonized form is then graphitized, heated in a non-oxidizing environment, until the carbon transforms to a graphitic structure. The carbon-carbon composites can be fabricated having multiple dimensions of reinforcement, where a plane of reinforcement is considered a dimension. A laminated carbon-carbon fabricated from fabric, where the fiber is oriented in the x and y direction is called 2-D. A cube with fibers oriented in the x, y, z planes would be classified as a 3-D architecture. A 3-D cube that also had fibers oriented at some angle to the intersection of the x and z plane would be considered a 4-D architecture.

Figure 3:
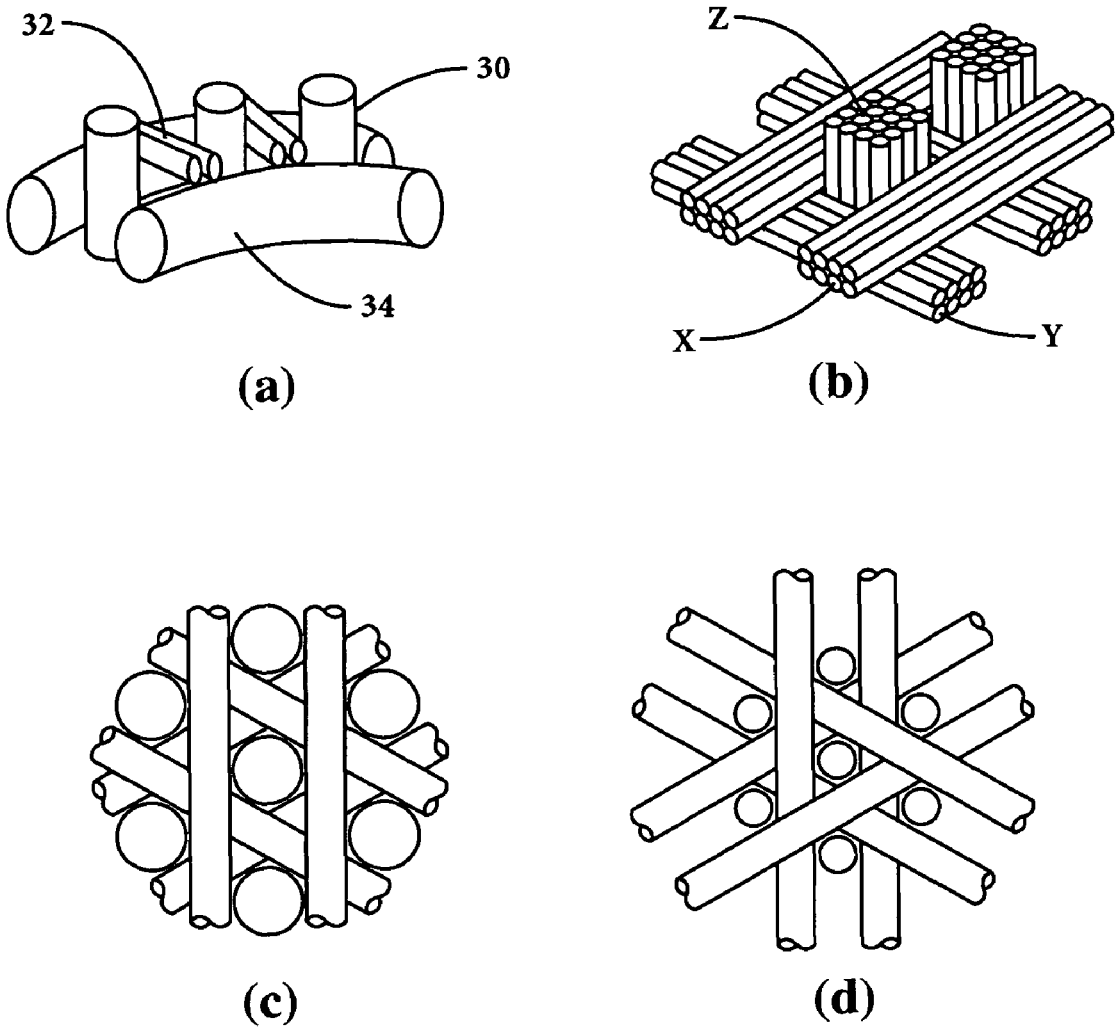
FIG. 3 is an illustration of alternate carbon-carbon composite weaves for the instant invention.

FIG. 3 illustrates several examples of different multiple dimensional carbon-carbon weaves that can be used for these specially formulated carbon-carbon composites. FIG. 3(*a*) demonstrates a 3-dimensional cylindrical weave in which 30 represents the axial, 32 represents the radial, and 34 the circumferential. FIG. 3(*b*) shows a 3-dimensional orthogonal in which there are clumped weaves of fibers oriented in the x, y, and z planes. A 3-dimensional matrix that has some fibers oriented at some angle to the x and z plane would be a 4-dimensional architecture. Examples of 4-dimensional architectures are shown in FIG. 3(*c*) (in-plane) and FIG. 3(*d*) (pyramidal). There are benefits and trade-off for each additional plane of reinforcement; there is only so much carbon fiber that can be placed in a unit volume, and the strength is a function of the longitudinal properties of the carbon fiber. Reinforcement can also be assembled into a preform in the cylindrical coordinate system with hoop, axial, and longitudinal reinforcement.

The various woven perform fabric structures exhibited in FIG. 3 (*a-b-c-d*) allow for placement of fibers in various directions to obtain required weave architecture and physical and mechanical properties. Applications requiring multi-directional woven structures usually are those where extremes in temperature and highly stressed states are encountered. Various high strength and high temperature fibrous materials in tow or yarn forms are used in weaving. These pre-forms are available for example from Fiber Materials, Inc. of Biddeford, Me. Fibers and filaments woven include quartz, zirconia, silicon carbide, carbon, graphite, tungsten and impregnated yarns. Various fibers can also be woven into the same preform (hybrid weaves). Composite preforms can be woven with fibers oriented in three directions, as with orthogonal (mutually perpendicular) or polar (cylindrical) constructions. In addition, fibers may be oriented in 4-, 5-, 7- or 11-directions, which are referred to as "N-D" constructions.

In a further aspect of improved performance refractory metals in the form of wire can be inserted into the fiber preform during its creation to a) provide a structural rigidity prior to consolidation. In the creation of the fiber preform that will be densified and graphitized into the carbon-carbon material that will be used as the armature, b) provide augmented current paths for the consolidated armature material, and c) provide enhanced high temperature strength and stiffness to the armature material when loaded with ultrahigh current and magnetic forces. The inserted refractory metal wires can be used to shape the preform into the ultimately desired shape and configuration, so that the consolidation process can be more efficient and cost less, and post consolidation machining will result in the loss of less carbon-carbon material. In a particular embodiment the refractory metal is positioned in the perform to form a backbone aligned to the predominant current pathway through the armature.

After the armature or rail is fully consolidated and graphitized non-refractory metals can be added to the perform that will allow a) enhanced electrical current pathways to be defined and b) provide a metal liquid lubricant between the armature and the launch rails. These post-consolidation metals can be low melt, high conductivity materials that will be extruded by the increase in temperature and the pressure due to the magnetic field that is created by the high current. This extruded molten metal will a) coat the launch rails, reducing wear, b) prevent the creation of a arcing gap between the armature and the rail, and c) prevent direct interaction between the armature and the rail. Exemplary materials include silver wire, silver solder, and tinless solder.

It has been found that carbon-carbon (CC) composites are the ideal substitute for aluminum alloy armatures and rails. These materials can be designed to withstand the unique loading conditions encountered during rail gun launch. Carbon-carbon composites exhibit increasing strength from their room temperature values to their maximum operating temperature of approximately 2000 degrees C.; this increasing strength will minimize C armature leg folding, which will help prevent transition to arcing plasma contact. These composites can be further improved and modified through machining, chemical, electro-chemical or plasma fiber deposition or surface treatments to further optimize their mechanical properties.

A rail gun armature assembly fabricated from carbon-carbon composites and potentially modified through machining, chemical, electro-chemical, or plasma deposition and conditioning, will provide a lightweight, high performance armature that will significantly reduce the amount of arcing that occurs during a rail gun launch, resulting in reduced rail wear.

It has also been found that the carbon-carbon (CC) composites prepared as described above are ideal substitutes for copper conducting rails in the electromagnetic rail guns. These materials can be designed to withstand the high pressures, high temperatures, and the electrochemical environment of a rail gun launch. Carbon-carbon composites exhibit increasing strength from their room temperature values to their maximum operating temperatures. These carbon-carbon materials can be modified through chemical treatments or through the use of electrochemically or plasma deposited metals to increase their conductivity and their wear resistance.

A rail gun rail fabricated from carbon-carbon composites and potentially modified through machining, chemical, electro-chemical, or plasma deposition and conditioning, will provide a high performance conducting rail that will show reduced wear.

Although certain embodiments of the present invention and their advantages have been described herein in detail, it should be understood that various changes, substitutions and alterations can be made without departing from the spirit and scope of the invention as defined by the appended claims. Moreover, the scope of the present invention is not intended to be limited to the particular embodiments of the processes, machines, manufactures, means, methods, and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufactures, means, methods, or steps.

The invention claimed is:

1. An electromagnetic rail gun comprising:

a. a pair of spaced rails defining an elongated bore therebetween and operable for receiving an armature along the length of said elongated bore, said armature having a leading edge and a trailing edge;

b. a power supply connected to the spaced rails to provide a current flow path through one of the rails, through the armature, and into the other rail to propel the armature along the elongated bore in the direction of the leading edge of the armature;

c. wherein said armature and spaced rails are fabricated from a fiber pre-form that is carbonized and then infused with a carbon matrix, and then carbonized again; and d. wherein this carbonized form is further infused with a carbon matrix and carbonized repeatedly until a pre-defined density is achieved; and e. wherein after said pre-defined density is achieved the carbonized form is heated in a non-oxidizing environment until the carbon transforms to a graphatized structure.

2. The electromagnetic rail gun of claim 1 wherein the carbon matrix is pitch.

3. The electromagnetic rail gun of claim 1 wherein said fiber pre-form is formed in a 3-dimensional cylindrical weave.

4. The electromagnetic rail gun of claim 1 wherein said fiber pre-form is formed in a 3-dimensional orthogonal weave.

5. The electromagnetic rail gun of claim 1 wherein said fiber pre-form is formed in a 4-dimensional in-plane weave.

6. The electromagnetic rail gun of claim 1 wherein said fiber pre-form is formed in a 4-dimensional cylindrical weave.

7. The electromagnetic rail gun of claim 1 wherein refractory metal wires are inserted in the fiber pre-form and aligned to the predominant current pathway through the armature before it is carbonized and densified with a carbon matrix.

8. The electromagnetic rail gun of claim 7 wherein said refractory metal is tungsten.

9. The electromagnetic rail gun of claim 1 wherein non-refractory metals are added to the fiber pre-form after it is fully carbonized, densified, and graphitized.

10. The electromagnetic rail gun of claim 9 in which said non-refractory metal is selected from the group consisting of silver wire, silver solder, and tinless solder.

* * * * *